US006428181B1

(12) United States Patent
Moriarty

(10) Patent No.: US 6,428,181 B1
(45) Date of Patent: Aug. 6, 2002

(54) PORTABLE WORK LIGHT WITH TOOL CONTAINER AND POWER OUTLETS

(76) Inventor: Eugene Denis Moriarty, 517 Euclid Ave., Oak Park, IL (US) 60304

( * ) Notice: Subject to any disclaimer, the term of this patent is extended or adjusted under 35 U.S.C. 154(b) by 22 days.

(21) Appl. No.: 09/586,269

(22) Filed: Jun. 2, 2000

(30) Foreign Application Priority Data

Jun. 3, 1999 (IE) ..... S990462

(51) Int. Cl.[7] ..... F21V 33/00
(52) U.S. Cl. ..... 362/154; 362/234; 362/387
(58) Field of Search ..... 362/101, 154, 362/184, 190, 191, 258, 387, 399, 249, 147, 219, 391, 404, 234; 43/17.5

(56) References Cited

U.S. PATENT DOCUMENTS 1,833,295 A * 11/1931 McCutchen ..... 362/154
3,099,398 A * 7/1963 Croteau ..... 362/387
3,294,968 A * 12/1966 Cloyd ..... 362/387
5,219,446 A * 6/1993 Klepac ..... 362/154

* cited by examiner

*Primary Examiner*—Y. My Quach-Lee
(74) *Attorney, Agent, or Firm*—Chapman and Cutler

(57) ABSTRACT

A portable device has a container portion for tools and materials and a handle for carrying and hanging, an electrical power supply section for obtaining power for and sending power to lights and tools, an illumination section for lighting a work area, and a base for standing the device on a surface. The device nests with other like devices when empty. The power cord preferably is stored on a reel within the base of the container, within the electrical section. The device enables tradesmen to be self-sufficient on a work site in building construction, providing light, storage, and power where needed, conveniently and inexpensively.

9 Claims, 2 Drawing Sheets

PORTABLE WORK LIGHT WITH TOOL CONTAINER AND POWER OUTLETS

I claim the priority of my co-pending Irish national application, serial no. S99 0462, filed Jun. 3, 1999.

1. Field of the Invention

The present invention relates to combination portable work lights and accessories, and in particular, to those suitable for use on building and construction sites.

2. Background of the Art

Working tradesmen including electricians, plumbers, carpenters, masons, dry-wallers, plasterers, ceiling installers, painters, and many others need task and general illumination at job sites, whether residential, commercial, retail, or industrial. In new construction where no general illumination is provided as by overhead light strings, this can involve considerable equipment to be carried by each tradesman or by a general contractor to the site daily. Such tradesmen also need power outlets convenient to their work locations for operating their power equipment, for battery chargers, and for task lighting. They also need to carry their tools and accessories to the work site.

These needs have been met with separate work lights, whether flood lamp style or as shrouded, heavy duty bulbs, with outlet strips and extension cords for power, and with tool boxes and bags for carrying same to the sites.

No unified system is known which facilitates setting up a work site with illumination, power, and tool storage in any sort of simple device that may be multiplied and stacked for larger jobs.

SUMMARY OF THE INVENTION

It is an object of this invention to meet the stated needs of the building trades in a simple, convenient, and economic manner with a device that is intuitively easy to use.

According to the invention, a portable light comprises a container formed by a base and a side wall extending upwardly from the base, the base and the side wall defining a hollow interior space for holding tools. The side wall defines an upwardly facing open mouth to the hollow interior region. A handle is provided on the container for facilitating carrying the container and also for hanging the container from a support or other structure. Electrical power is supplied to the device through a cord that may be stored on a reel within the base, and power outlets are provided about the base for plugging in tools and additional portable light devices. A light source is built into and protected by the base of the container, so that when the container is hung by the handle the light source illuminates the surrounding work area. A stand is provided beneath the light source for supporting the container on the ground.

In one embodiment of the invention, the light source is located in and beneath the base of the container, and preferably it is protected by a protective casing of translucent or transparent material about and beneath the base. Ideally, the stand is formed by a protective frame extending downwardly from the base.

In another embodiment of the invention, the light source comprises an electrically powered bulb, and preferably at least three electrically powered bulbs arranged at 120° intervals relative to each other around a central axis of the container. Ideally, the protective stand allows emission of light through 360° around the central longitudinal axis.

In a further embodiment of the invention, a cable reel is provided in the container for carrying a long cable for powering the light source. Ideally, the base comprises two spaced-apart skins, and the cable reel is located between these skins. Preferably, the cable reel defines a rotational axis that coincides with the central longitudinal axis of the container.

A battery back-up power supply may be provided, and ideally, is also located between the skins of the base.

At least one electric power socket or outlet is provided on the container, and preferably, a plurality of electric power sockets are provided. Each power socket is powered from the cable on the cable reel or from the battery through a power converter of appropriate capacity, through rotary contacts or the like, for distributing 110–120-volt, AC electrical power at the site.

The container comprises a substantially cylindrical side wall extending upwardly from the base, and advantageously the side wall is of frusto-conical shape for facilitating nesting of one tool container into another. Other container shapes, as oval and rectangular, can also be used.

THE PREFERRED EMBODIMENTS

Figure 1:
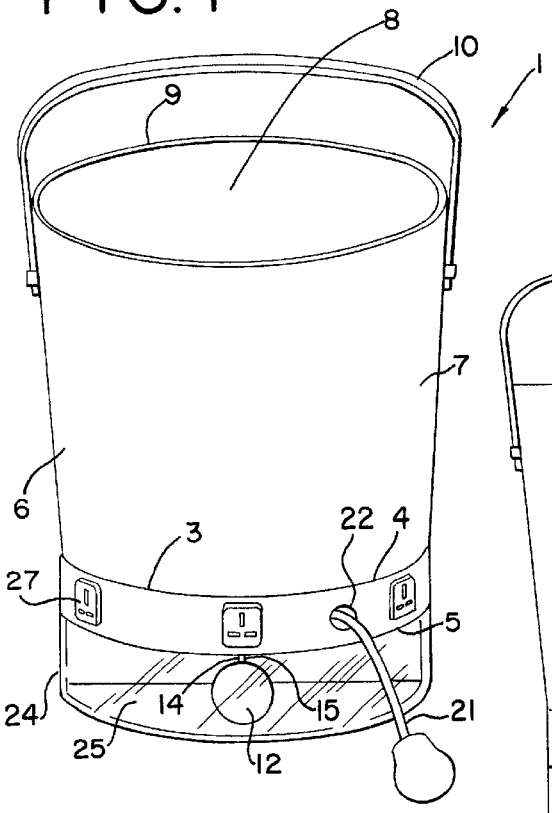
FIG. 1 is perspective view of a device with portable light embodying the invention.

A portable work light, container, and power source device 1 as shown in the drawing figures provides a light source 12 for illuminating a work area, for example, in a building or construction site. The device 1 is used for storing and carrying tools 2, and it provides power outlets 27 around its base connected through a long cord 21 to a source of electrical power.

Figure 5:
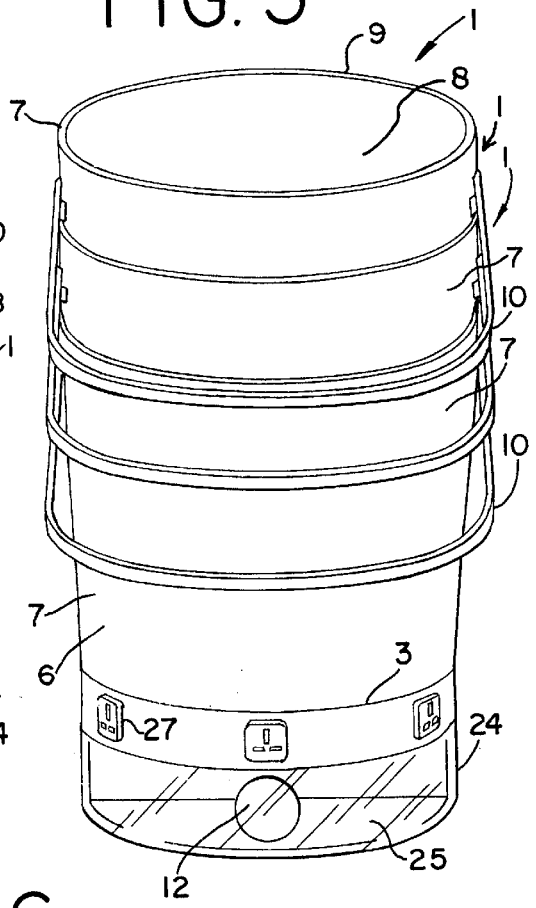
FIG. 5 is a perspective view of a number of the devices of FIG. 1, nesting one into the other.

The device 1 comprises a container portion 7 with an electrical base 3 formed by a pair of skins, namely, an upper skin 4 and a lower skin 5. The container portion 7 also has, in this embodiment, a frusto-conical sidewall 6 extending upwardly from the base 3. The sidewall may be oval or rectangular in section without varying from the invention, but preferably in each case is tapered outwardly toward the top. The sidewall 6 and the upper skin 4 of the base 3 define a hollow interior region 8 for carrying the tools 2; the side and base are preferably sealed together so that liquids or granular material may be carried if desired without spillage. The sidewall 6 defines an upwardly facing open mouth 9 to the hollow interior region 8, and as noted it is splayed slightly outwardly in the upward direction for accommodating nesting of one device 1 with container 7 into a similar device with container 7, as in FIG. 5.

A handle or bail 10 is pivotally connected to the side wall 6 adjacent the open mouth 9, for carrying the device 1 and container 7, and also for hanging the device 1 from a structure, for example, from an overhead pipe, hook, ceiling or the like. The device may be hung on or over such structure either directly by the handle or bail 10, or by means of an S-hook, a wire, or the like (not shown).

Figure 2:
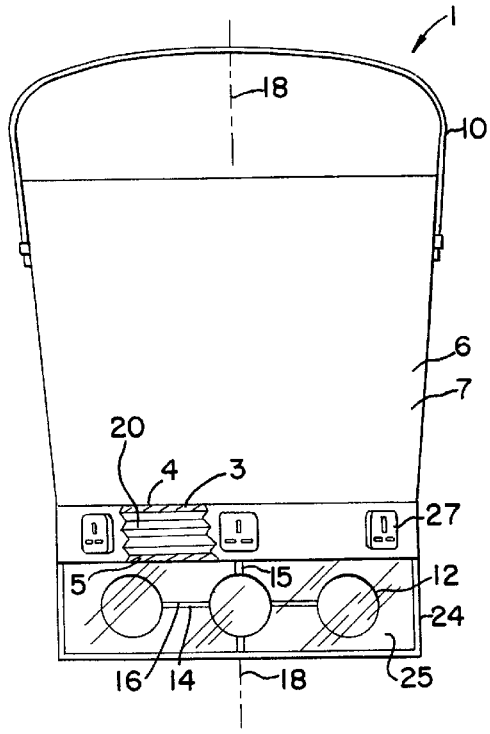
FIG. 2 is a partly cut away side elevational view of the device of FIG. 1.
Figure 3:
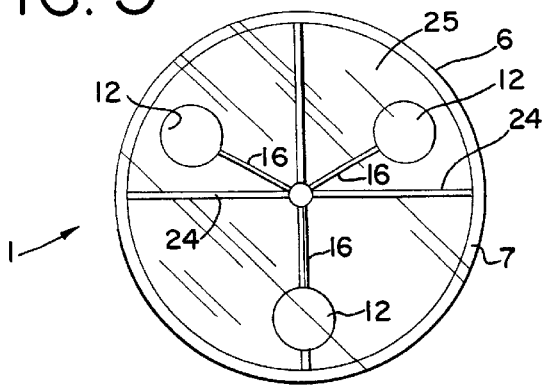
FIG. 3 is an underneath plan view of the device of FIG. 1.
Figure 4:
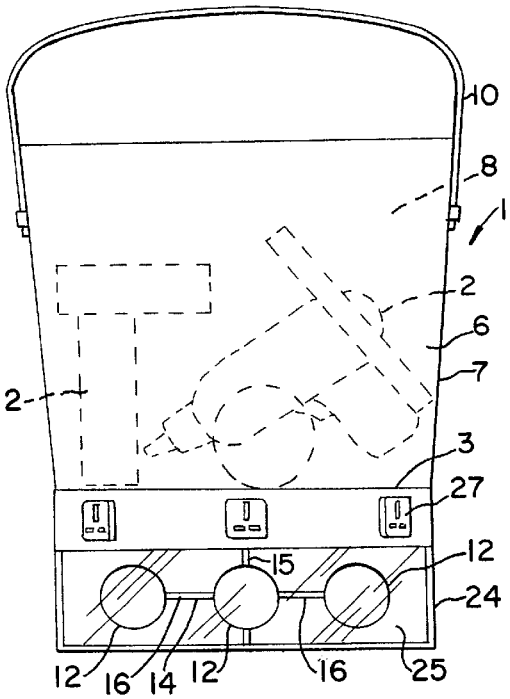
FIG. 4 is a side elevational view of the device of FIG. 1.
Figure 6:
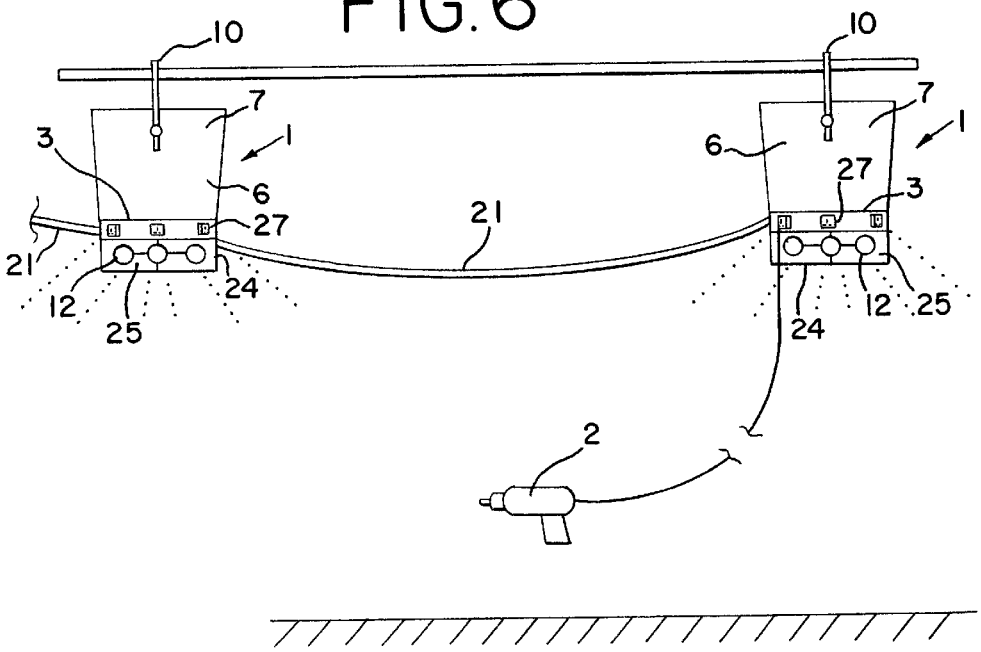
FIG. 6 is a side elevational view illustrating two devices of FIG. 1 in use at a work site.

The light source for lighting a work area when the device 1 with its container 7 is suspended by the handle 10 from a ceiling or the like, as in FIG. 6, comprises about three electrically powered bulbs 12 located beneath the lower skin 5 of the base 3. The bulbs 12 are carried on a frame 14 that extends beneath the base 3 and lower skin 5. The frame 14 comprises a conduit 15 that extends vertically downwardly from the lower skin 5, plus three horizontally extending conduits 16 which extend radially from the conduit 15. The conduits 16 terminate in bulb holders (not shown) for receiving screw-in or similar bulbs 12. The vertically downwardly extending conduit 15 coincides with a central axis 18, as in FIG. 2, of the device 1 and the container 7. The horizontal conduits 16 radiate outwardly at 120° relative to each other, for providing 360° of illumination from the device 1. More or fewer bulbs and conduits may be used.

A reel 20 for carrying a power supply cable 21 is located between the upper and lower skins 4 and 5 of the base 3. The rotational axis of the reel 20 coincides with the central axis 18 of the container 7, so that the cable 21 can readily be wound onto the reel 20 and so that a rotary wiper or similar system (not shown), can transfer the power, neutral, and ground wire connections to the device 1. A cable outlet 22 in the sidewall 6 passes the power cable 21 from the reel 20. Preferably, the reel 20 is spring powered for automatically winding the cable onto the reel. A further connection (not shown) from the cable 21 goes to the bulb holders (not shown) through the conduits 15 and 16 for providing electric power to the bulbs 12. Other arrangements for storing the cord 21 may be alternatively be used, such as simply stuffing the cord into the opening 22 to be retained therein; alternatively the cord may be wrapped about the outside of the device 1 or coiled and placed into the container 7, but the reel is much preferred.

A ground-engaging framework 24 extends downwardly from the container base 3 in the device 1 for acting as a stand for the device 1 and container 7 when the device 1 is not suspended by the handle 10. The framework 24 also protects the bulbs 12 from shock and breakage. A casing or cover 25 of transparent or translucent plastic is preferably secured within the frame-work 24 for further protecting the bulbs 12 from breakage as well as the user from burns from the hot surfaces.

A battery back-up power pack (not shown) may also located in the base 3 between the skins 4 and 5, for providing limited, battery back-up at least for lighting, through bulbs 12 or from other, low-voltage bulbs, in the event of a local power failure. The battery pack may if desired have sufficient power, when coupled through an AC power converter, to permit up to three hours lighting and power for tools, for working in the absence of, or even after a failure of, regular power.

Three electric power sockets or outlets 27 are located in the side wall 6 between the upper and lower skins 4 and 5. These are connected to the power cable 21 through the reel 20, for distributing power for use in powering tools and the like. The electrical outlets 27 are shown with schematic sockets, and US standard 110–120 volt, 15 or higher amperage outlets would normally be used, depending on the capacity ratings of the related systems. Ground fault detector outlets can equally be used on a controlling outlet if appropriate, for added safety.

In many cases, a plurality of the devices 1 can be provided on a building or construction site at spaced apart intervals. The devices then are powered one from another by connecting the power cable 21 of one device into one of the power sockets 27 of the next adjacent device, as shown in FIG. 6.

The portable device 1 is used as a tool carrier as well as providing a light source for illuminating a work area and providing power for doing work there. Tools 2 are carried in the hollow interior region 8, and the device 1 may be supported on the ground by the ground-engaging framework 24. When it is desired to use the device 1 as a light source, the container 7 is suspended from a suitable support or ceiling in or above the area to be illuminated; alternatively, if empty it can as well be inverted, to rest on the open mouth 9, for use in illuminating upwardly. The cable 21 is unwound from the reel 20 and connected into a power source, which may be a fixed electrical power socket, permanent or temporary, or may be a power socket 27 of an adjacent portable light device 1. The bulbs 12 on being powered thus illuminate the work area below the device 1 and throughout 360° around the portable light 1. Power tools 2 or the like may be powered from the power sockets 27 of the device 1. Low voltage bulbs may be added for use with the battery back-up, if appropriate.

Many variations may be made in the invention as shown and its manner of use, without departing from the principles of the invention as described herein and/or as claimed as the invention. Minor variations will not avoid the use of the invention.

I claim as my invention:

1. A portable device for conveniently providing light and power to a working space such as a building or construction site and for carrying tools and accessories to and from the working space, the device comprising a container, at least one electrical outlet, and a light, wherein:

said container is formed by a surrounding side wall and has a bottom and an upward opening for receiving and holding one or more tools and accessories therein, and the container having a carrying and hanging handle joined to it for lifting and suspending the device;

an electrical section is joined to the bottom of the container and integrated therewith, the electrical section comprising an electrical cord connected electrically with the at least one electrical outlet located at an outer periphery of the section, the cord being adapted to bring electrical power to the device and each said outlet therein; and wherein an illumination section is joined to the container adjacent the electrical section, the illumination section comprising said light connected electrically to the electrical cord and powered normally from it, and the illumination section further including a framework for supporting and standing the device upright on a surface.

2. A portable device as in claim 1, wherein the container wall, electrical section, and illumination section are frustoconical in exterior shape, and wherein the handle can be moved aside, so that the device can nest with another identical device in a stack.

3. A portable device as in claim 1, wherein the container wall is continuous about its periphery and is sealed with the bottom, for use of the device as a carrier of liquid and granular substances.

4. A portable device as in claim 1, wherein the electrical section comprises a reel for wrapping the cord upon it for convenient storage within the electrical section.

5. A portable device as in claim 4, wherein the reel is spring-biased to draw the cord onto the reel for storage.

6. A portable device as in claim 1, wherein the illumination section further comprises a light-transmitting cover about and enclosing the light and located inwardly of the supporting framework.

7. A portable device as in claim 1, wherein the light comprises at least three bulbs for providing light to a work site.

8. A portable device as in claim 1, wherein the electrical section comprises at least three outlets for use in the working space.

9. A combination container, illuminator, and power source device for use on and in connection with a work site such as a construction or building site, the device comprising:

a container section comprising an upstanding wall and a base joined together for accepting and retaining therein tools and substances helpful to a user on the work site;

a power supply section comprising a peripheral wall joining continuously with the wall of the container section and located downwardly of said container section, at least one electrical outlet provided in the peripheral wall of the power supply section, and a power supply connected to the outlet; and an illumination section located adjacent the power supply section and comprising at least one lamp powered from the power supply section.

* * * * *